United States Patent [19]

Teodorescu et al.

[11] 4,002,110

[45] Jan. 11, 1977

[54] AUTOMATIC OBTURATOR FOR A GASODYNAMIC VENTILATION DEVICE

[75] Inventors: Constantin Teodorescu; Ilie Chiriac; Ion Stelian Iacob, all of Bucharest, Romania

[73] Assignee: Institutl Pentru Creatie Stiintifica Si Tehnica, Bucharest, Romania

[22] Filed: May 6, 1975

[21] Appl. No.: 574,927

Related U.S. Application Data

[62] Division of Ser. No. 455,338, March 27, 1974, abandoned.

[30] Foreign Application Priority Data

Apr. 2, 1973 Romania ..... 74347

[52] U.S. Cl. ..... 98/43 R; 137/527.8; 417/174

[51] Int. Cl.[2] ..... F24F 13/10

[58] Field of Search ..... 98/32, 37, 38, 43, 40 N, 98/59, 116, 119, 122; 417/174, 189, 182; 137/527.6, 527.8

[56] References Cited

UNITED STATES PATENTS

| | | | |
|---|---|---|---|
| 250,073 | 11/1881 | Hudson | 417/174 X |
| 2,873,662 | 2/1959 | Drager | 98/119 |
| 3,442,086 | 5/1969 | Nieman | 417/174 X |
| 3,479,947 | 11/1969 | Myers | 98/116 |

*Primary Examiner*—Wayner William E.
*Assistant Examiner*—William E. Tapolcai, Jr.

[57] ABSTRACT

Gasodynamic ventilation device consisting of a prime ejection channel provided with a nozzle for the introduction of the operative fluid and a secondary ejection channel mounted coaxially with a prime ejection channel provided at the upstream end with an admission inlet for the ambient air provided with a silencing screen. The primary and secondary channels are provided with vanes so that the two channels are separated by a section which constitutes the inlet for the admission of ambient air.

In a first modified construction of the secondary channel is provided a shield griller in a second variant the secondary channel is provided with automatic obturating members consisting of a front wall being constructed as a flap and two lateral walls, the entire obturator being pivotally mounted.

3 Claims, 5 Drawing Figures

AUTOMATIC OBTURATOR FOR A GASODYNAMIC VENTILATION DEVICE

Figure 1:
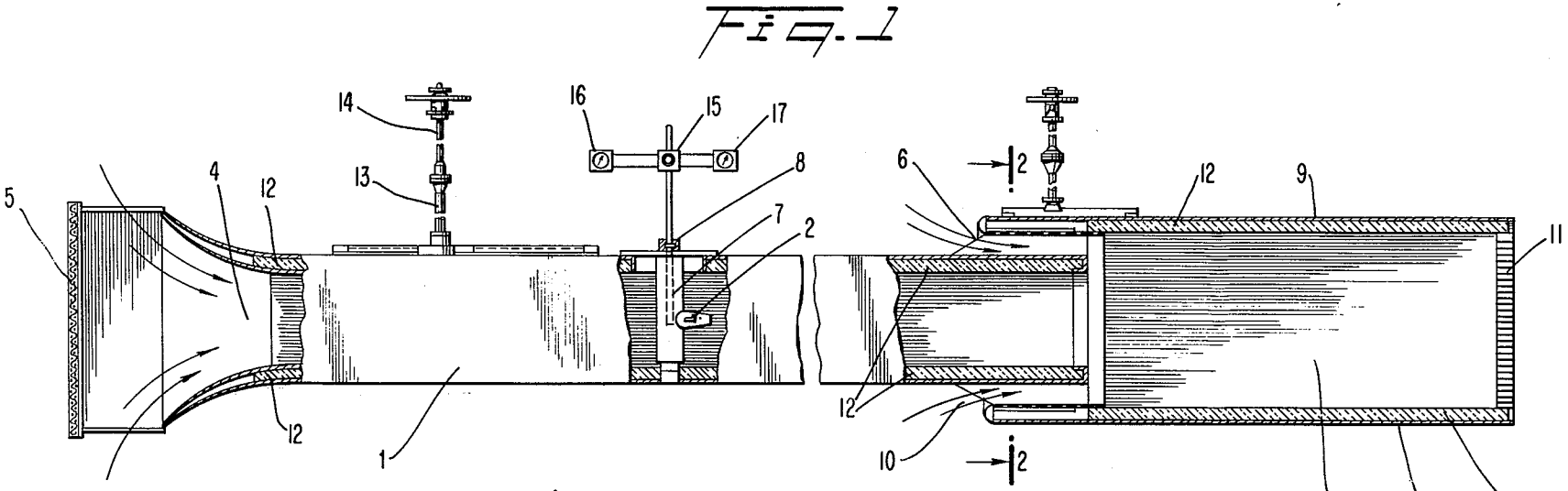

This is a division of application Ser. No. 455,338 filed Mar. 27, 1974, now abandoned.

The present invention relates to a gasodynamic ventilation device including an ejector, entraining and evacuating the polluted air from the environment by means of a jet of active fluid (steam, compressed air or a liquid under pressure), and to an automatic obturating device with adjustable flaps.

Ventilation device are known which are based on the ejector principle. Thus, there are ventilators with a gas or steam jet operating on the principle of a jet pump and having functionally two sections: a nozzle for the operative fluid and a diffuser constituting together with the nozzle a convergent - divergent channel for the discharge of the operative fluid, the entrainment of the ambient air being achieved due to the pressure drop upstream of the diffuser because of the increased speed of the operative fluid in the convergent section of the nozzle.

There is also known a ventilation device which is based on the same principle and is used for air conditioning in ship cabins, its characteristic being that both the nozzle and the diffuser, which constitute one single unit with the mixture chamber, have an annular shape and are mounted on the cabin ceiling together with the armature. The disadvantage of those devices is a reduced efficiency, the mass of the secondary fluid entrained from the ambient air being reduced. The gasodynamic ventilation device, according to the invention, eliminates the above mentioned disadvantage, such device has a prime ejection channel which is adapted for the intoduction of an operative fluid, and a secondary ejection channel, coaxially mounted, both of them having the same section (square for example) and having sound-absorbent panels on the inside wall. The first channel is provided at the upstream end with an air inlet and a silencing screen; at the downstream end the first channel is provided with vanes which provide the connection with the secondary ejection channel. The latter channel has an inlet for the secondary air and, in a first stage, a shield grid. The device is supplied with operative fluid under pressure from a suitable source of supply by means of an automatic control valve; the control of such valve is performed by the transducers of an analyzer of the concentration of noxious gases in the atmosphere, or by the transducers of a thermal regulator at a nozzle which is profiled according to the parameters of the operative fluid and to the nominal value of the air feed which has to be exhausted. The absorption of the polluted or warm air from a room is done by means of the evolution of the operative fluid in the prime ejection channel, the process of turbulent mixing determining the decrease of the static pressure in this channel and consequently the absorption of the ambient air through its inlet.

The mass of the turbulent mixture is increased in the secondary channel by a supplementary absorption of ambient air which penetrates through the section separating the two channels by reason of the increase of the interior and exterior mutual contact surfaces of the fluid jets which have different speeds. The mixture finally passes through the shield grid and thus being exhausted into the atmosphere.

In a modified device in accordance with the invention, the gasodynamic ventilation device is provided with an automatic obturating device on the front wall instead of on the shield grid, such obturating device having the shape and functioning as a flap with two lateral walls. The obturating device is pivotally mounted on a frame located at the upstream end of the secondary ejection channel by means of a pivot pin penetrating the lateral wall. On the upper part of the obturator there is a counterweight fixed thereto with screws, the exterior of the obturator being provided with some vanes for its horizontal setting, for the linearization of flow, and for the increase of solidity, the automatic opening of the obturator takes place due to the resulting moment of the buoyant force about the pivot pin, which surpasses the difference between the moment of the weight of the part of the obturator and that of the counterweight about the same pivot pin.

The shutting of the obturator takes place at the disappearance of the buoyant force, when the weight moment of the lower part of the obturator surpasses that of the counterweight.

Figure 2:
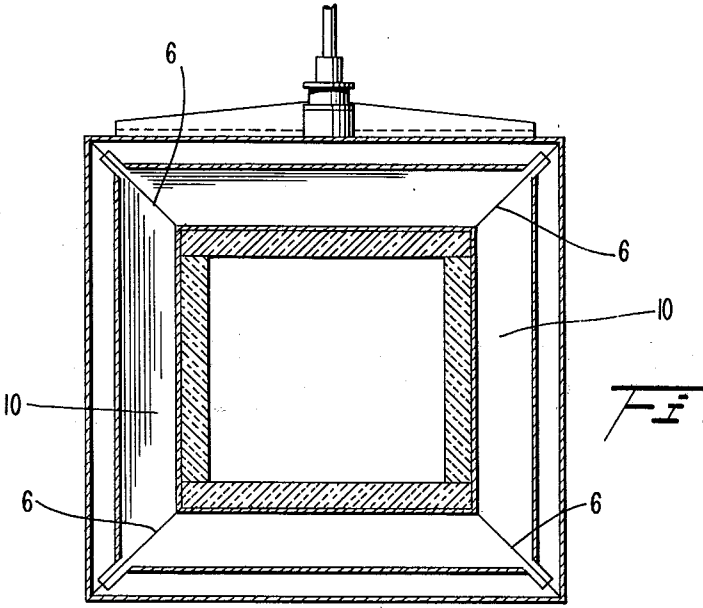
Figure 3:
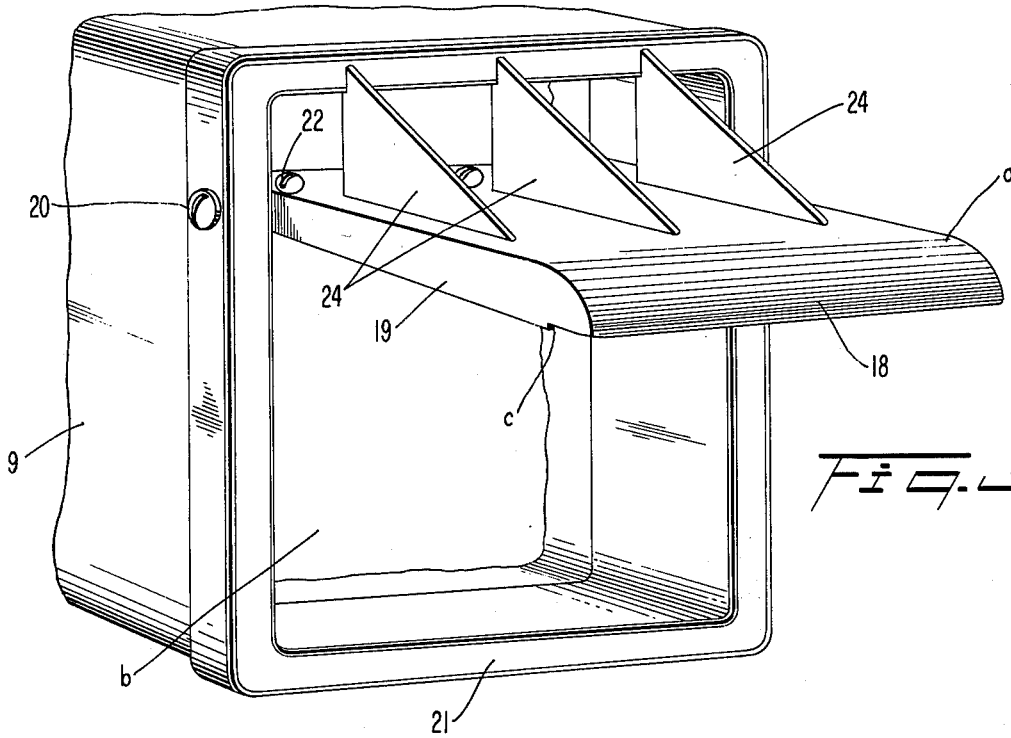
Figure 4:
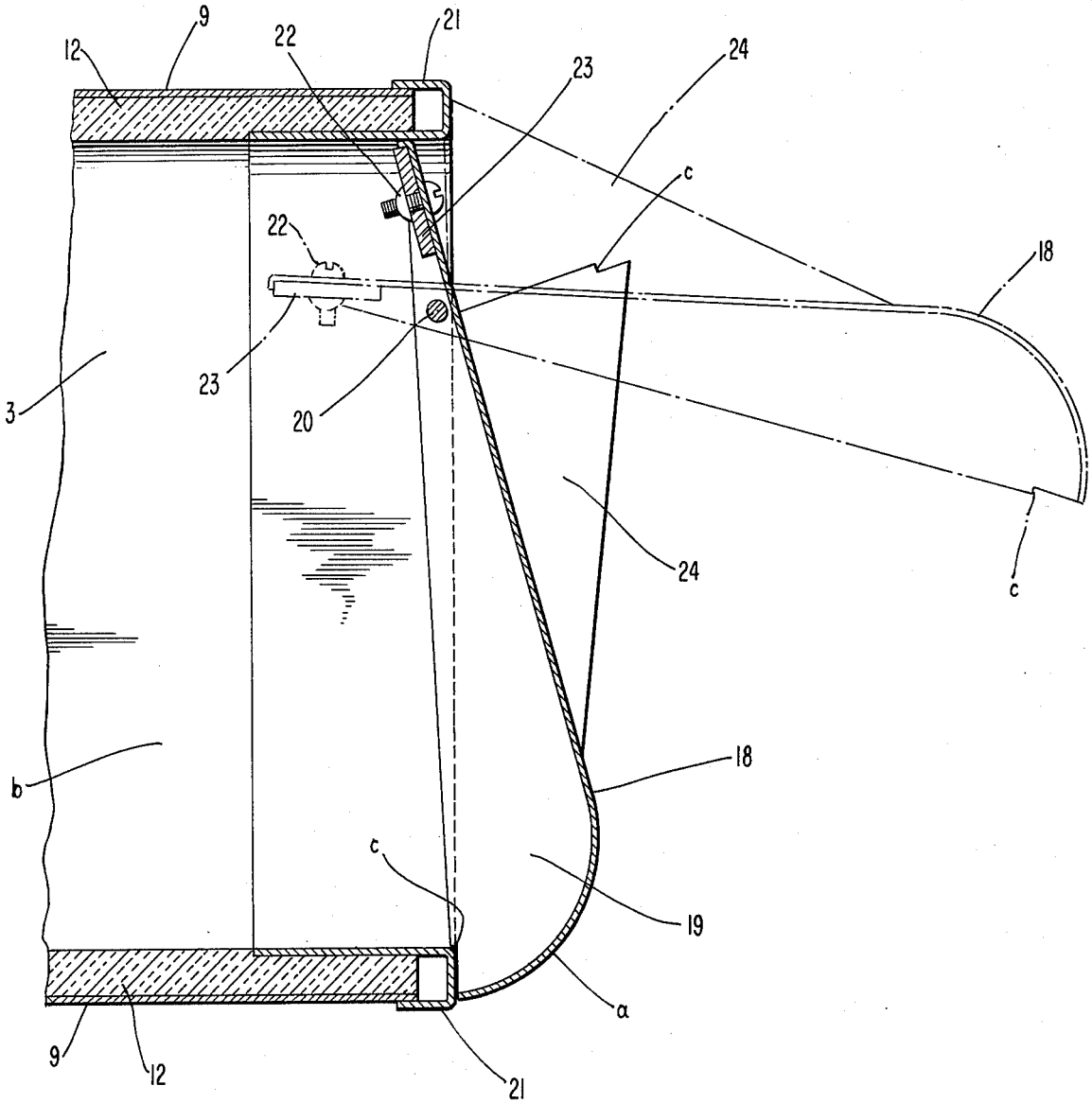

In the accompanying drawings showing the device according to the invention:

FIG. 1 — is a longitudinal section through the device;

FIG. 2 — is a cross-section taken along the line A — A in FIG. 1;

FIG. 3 — is a fragmentary axial of the obturator in open position;

FIG. 4 — is a view in longitudinal section through the same obturator; and

Figure 5:
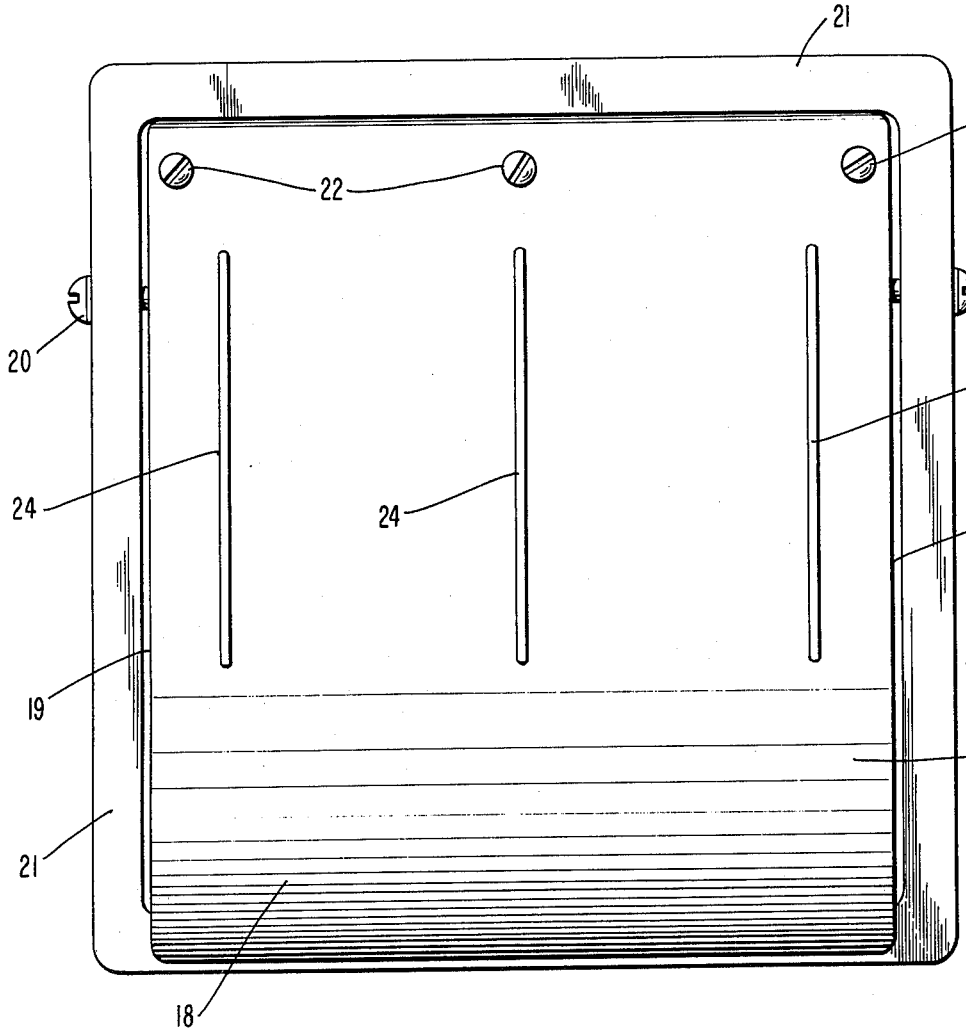

FIG. 5 — is a top view of the obturator.

The device illustrative according to the invention has a primary ejection channel 1, a nozzle 2 for the introduction of the operative fluid, and a secondary ejection channel 3.

The primary ejection channel 1 formed by a tube having, for example, a square section and provided at the upstream end (at the left in FIG. 1) with an admission inlet part 4 for ambient air and with a silencing screen 5. The downstream end of the device is provided with vanes 6 by means of which the primary channel is connected with the secondary ejection channel 3.

The nozzle 2 is shaped both according to the nature and the parameters of the operative fluid and according to the nominal value of the air feed that has to be exhausted. The connection to the supply network being provided by means of a blade 7, fixed rigidly on the walls of the prime ejection channel 1 and of an intermediate part 8.

The secondary ejection channel 3 is mounted coaxially with the primary ejection channel and consists of a tube 9 having, for example, a square section, an inlet for the secondary air 10 and a shield grid 11, or, in a variant structures, with an automatic obturator.

Both the walls of the primary ejection channel 1 and those of the secondary ejection channel 3 have on the inner side some sound-absorbent panels 12 made of mineral wool and joined to one another by means of two glass felt strata and of an adhesive. Such sound-absorbent treatment exposes minimal roughness and achieves a strong attenuation of the gasodynamic noise generated by the evolution of the operative fluid and provides a perfect anticorrosive protection.

In order to fasten the device in the enclosure for which it is designed, it is provided with hangers 13 and extensible rods 14 which are adjustably secured to the hangers 13.

The nozzle 2 is fed with operative fluid under pressure from a pressure source (not shown) by means of a valve 15 which is automatically controlled by a series of transducers of a pollution concentration analyzer 16 or by those of a thermal comfort regulator 17 such as a thermostat.

In a modified construction shown in FIG. 4, the shield grid 11 is replaced by an automatic obturator consisting of a front wall 18 made out of thin plate, having and functioning as a pivotally mounted flap *a* and provided on its lower portion with two lateral walls 19.

The upper part of the obturator is penetrated by a pivot pin 20 about which the obturator pivots, the pin 20 being fastened in a frame 21 which is located at the downstream end of the exit *b*.

On the same upper part of the obturator towards the upper edge of the frame 21, and fastened by means of screws 22, there is a counterweight 23 which is determined so that the weight moment of the lower part of the Coanda flap *a* surpasses that of the counterweight 23 and the obturator to obstructs automatically the exit *b* whenever the device is not at work.

During the operation, the lower part of the obturator is wet pushed away bringing it into the "open" position due to the wet buoyant/force generated by the exhausted air flow on the flap *a*.

Triangular vanes 24 mounted on the outside of the Coanda flap *a*, have the function of limiting the opening, linearizing the flow and stiffening the obturator.

With that end in view the triangular vanes 24 are located on the exterior of the front wall 18 so that in the "open" position of the obturator the top of the triangular vanes 24 come into contact with the upper edge of the frame 21 at the exhaust end of the exit *b*.

The tops of the triangular vanes 24 are each provided with a cut-out *c* to receive the upper edge of the frame 21 when the obturator is fully open. The lateral walls 19 of the flap *a* at its outer end with which it engages the frame 21, after the operation is stopped and after the obturator takes the "close" position, are provided with the same cut-out.

The device functions as follows:

When the air in a plant provided with the device of the invention becomes polluted or its temperature surpasses the limits prescribed by the labor protection standards, the analyzer 16, and/or the regulator 17, orders the opening of the valve 15 which permits the feeding of the nozzle 2 with the operative fluid (steam or compressed air) thus setting the device in operation. Leaving the nozzle 2, the operative fluid passes through the primary ejection channel 1; by the process of turbulent mixing there is a decrease in the static pressure in channel 1, and as a result, the drawing in of the warm or polluted air from the enclosure through the inlet 4 takes place. Further on, the mixture of operative fluid and absorbed air enters the secondary ejection channel 3 in which, by the same process of turbulent mixing, a supplementary absorption of the ambient air through the flow section separating the two channels is produced. From the secondary ejection channel 3 the mixture of absorbed air and operative fluid passes through the shield grid 11, in the first embodiment, being then evacuated into the atmosphere.

When the purity or the temperature of the air comes back again to normal limits, the analyzer 16 and/or the regulator 17 orders the closing of the valve 15 and the device stops. The device operates only when necessary; thus the device operates with a minimal consumption of operative fluid.

The obturator with which the device is provided in the embodiment of FIG. 4, functions as follows:

The obturator opens automatically when the resultant moment of the buoyant force about the pivot pin 20 surpasses the difference between the moments of the weight of the lower section of the obturator and of the counterweight about the pivot pin 20.

When the buoyant force disappears, the weight moment of the lower section of the obturator surpasses that of the counterweight 23 so that the obturator automatically shuts the exit *b*.

The device, according to the invention, has the following advantages:

entire reliability;
reliable functioning in explosive medium;
insensitivity to corrosive agents;
possibility of a continuous control of the functioning state;
constructive-functional simplicity;
increased profitability;
large applicability to a great variety of places;
it does not allow the penetration of dust, impurities and of the cold air from the exterior by means of the obturator;

Although the invention is illustrated and described with reference to a plurality of preferred embodiments thereof, it is to be expressly understood that it is in no way limited to the disclosure of such a plurality of preferred embodiments, but is capable of numerous modifications within the scope of appended claims.

What is claimed is:

1. A gasodynamic ventilation device consisting of a primary ejection channel, an injection nozzle within the primary ejection channel and facing downstream, a secondary ejection channel mounted coaxially of the primary ejection channel and connected to the downstream end of the primary ejection channel by vanes so that the two channels are separated by the section which constitutes an inlet for the admission of secondary air, the primary ejection channel being provided at its upstream end with an admission inlet for the ambient air, and the downstream end of the secondary ejection channel being provided with an exit port having upper and lower edges, an automatic obturator disposed at the exit port of the secondary channel, the obturator having the shape of a flap and having a bore extending therethrough intermediate its ends, a pivot pin supported at the exit port of the secondary channel in parallel relation to and intermediate the upper and lower edges, the pivot pin extending through the intermediate bore of the flap to support the flap for pivotal movement between an open position and a closed position, and a counterweight affixed to the upper end of the flap.

2. A gasodynamic ventilation device according to claim 1, wherein the forward surface of said flap is provided with at least two laterally-spaced triangular vanes, said vanes being of such shape that the tops of the vanes engage the upper edge of the exit port of the secondary channel when the obturator is in said open position.

3. A gasodynamic ventilation device according to claim 1, wherein said flap has a substantially arcuate bottom portion and a substantially flat top portion.

* * * * *